US005270066A

United States Patent [19]

Pawlowski

[11] Patent Number: 5,270,066

[45] Date of Patent: Dec. 14, 1993

[54] DOUBLE-CENTER WALL MICROWAVE FOOD PACKAGE

[75] Inventor: Thomas D. Pawlowski, Neenah, Wis.

[73] Assignee: James River Corporation of Virginia, Richmond, Va.

[21] Appl. No.: 392,576

[22] Filed: Aug. 11, 1989

[51] Int. Cl.[5] ..... B65D 85/00

[52] U.S. Cl. ..... 426/107; 219/10.55 E; 229/120.04; 426/113; 426/234; 426/243

[58] Field of Search ..... 426/107, 113, 234, 243; 219/10.55 E; 229/120.04, 114

[56] References Cited

U.S. PATENT DOCUMENTS

| | | | |
|---|---|---|---|
| 2,697,544 | 12/1954 | Morand | 229/120.04 |
| 2,917,218 | 12/1959 | Guyer | 426/113 |
| 3,865,301 | 2/1975 | Pothier et al. | 426/107 |
| 4,230,924 | 10/1980 | Brastad et al. | 219/10.55 E |
| 4,267,420 | 5/1981 | Brastad | 219/10.55 E |
| 4,594,492 | 6/1986 | Maroszek | 219/10.55 E |
| 4,794,005 | 12/1988 | Swiontek | 426/107 |
| 4,820,893 | 4/1989 | Mode | 426/107 |
| 4,933,193 | 6/1990 | Fisher | 426/234 |
| 4,935,592 | 6/1990 | Oppenheimer | 219/10.55 E |
| 4,943,439 | 7/1990 | Andreas et al. | 426/234 |

*Primary Examiner*—Steven Weinstein
*Assistant Examiner*—Anthony Weier
*Attorney, Agent, or Firm*—Sixbey, Friedman, Leedom & Ferguson

[57] ABSTRACT

A package for use in storing, vending and microwave cooking of food products. The package includes a double center wall which divides an interior food cavity into two food compartments. The center wall and the remaining interior surfaces of the container are coated with a microwave interactive layer thereby exposing an increased surface area of the food articles to the microwave interactive layers. Improved surface cooking, such as surface browning and crisping are achieved, as well as increased convenience in packaging and cooking.

40 Claims, 4 Drawing Sheets 10
24
24
27
27
40
35
36
36
21
20
30
41
30
22
23
40
26

35
35a
35b
60
62
26
40
41

DOUBLE-CENTER WALL MICROWAVE FOOD PACKAGE

TECHNICAL FIELD

The invention relates to packages for storing and microwave heating of foods and, particularly to packages having a component that will produce a heating effect when exposed to microwave energy.

BACKGROUND ART

Microwave oven cooking continues to increase due to the associated convenience and time savings. The growth in microwave oven usage has been accompanied by a similar growth in the demand for microwaveable prepared foods. Microwave packages are increasingly popular since they allow the food product to be stored and cooked in the same container, further increasing the convenience in microwave cooking. It is known that the configuration and materials in microwave packages can have a substantial effect upon the result of microwave cooking. However, many foods cooked in a microwave do not satisfy the customers' expectations or tastes, since they may lack many of the characteristics which consumers generally associate with such products. In particular, consumers are often dissatisfied with food products which should have a browned and/or crisped surface when properly cooked, since the microwave cooked version may result in a soggy or uncooked exterior. In addition, if cooking of the food product is continued in an attempt to achieve crispness, other portions of the food product may become overcooked.

Numerous attempts have been made to provide microwave cook-in food packages which are adapted to compensate for the lack of food browning or crisping associated with microwave cooking. However, previous attempts have not provided an entirely satisfactory package for cooking edge surfaces of food products such as to provide browning or crispness, particularly where it is desired to package a number of food product articles having surfaces requiring browning or crisping for customer satisfaction.

One approach to providing browning, as disclosed in U.S. Pat. No. 4,267,420 to Brastad and U.S. Pat. No. 4,230,924 to Brastad et al. , includes the use of flexible sheets of microwave interactive materials wrapped closely about food items wherein the interactive material converts at least a portion of the impinging microwave energy into heat for browning the food surface. However, wrapping individual food items increases the cost and complexity associated with packaging the food products. In addition, where a number of food items are packaged together, the consumer may find it cumbersome to remove the wrappings from the food products, particularly when the food product is hot after cooking.

U.S. Pat. Nos. 4,594,492 to Maroszek and 4,794,005 to Swiontek disclose microwave packages in which a microwave interactive layer is provided on interior surfaces of the container. In each of these arrangements, a tray or insert having a microwave interactive layer thereon is provided such that the microwave interactive layer is closely adjacent to the food product, thereby improving browning of the food product portions adjacent the tray or insert. However, the manufacture of separate inserts or trays, and orientation of the inserts within the container complicates packaging. Moreover, these patents do not address the problems associated with cooking a food portion which includes a plurality of food articles, each having surface areas for which crisping and/or browning is desired. For example, in U.S. Pat. No. 4,594,492 to Maroszek, an insert having a microwave interactive layer thereon is biased from the top of the carton towards a food product, such as a plurality of sausage links arranged in a row. However, the majority of the browning occurs at the bottom and top surfaces of the sausage links and such an arrangement would not be suitable for browning side portions of a plurality of articles, since a majority of the article side portions are remote from the microwave interactive layers, and the side surfaces are generally in contact with adjacent food articles.

Particularly where the food articles are of an irregular shape, having side surfaces as large or greater than the top and bottom surfaces, prior art packages have been insufficient in properly cooking the food article side surfaces and at best only brown or crisp the side surfaces of the food articles which are adjacent the container side walls. Where it is desired to package two or more rows of food articles, it becomes increasingly difficult to properly cook the side surface areas since the side surface area of the articles in the center of an array of food articles are remote from the microwave interactive layers associated with the interior surface areas of the package.

Thus, a microwave package is needed which is capable of heating side portions of food articles, particularly where the food articles have large side surfaces and a number of such food articles are packaged and cooked together, for example two or more articles; or two or more rows of food articles.

SUMMARY OF THE INVENTION

In view of the foregoing, it is an object of the invention to provide a package for storing and microwave cooking having an improved ability to cook surfaces of food articles contained therein.

It is another object of the invention to provide a microwave package capable of browning and/or crisping an increased portion of the side areas of a food product, particularly for food products having large side surface areas and/or where it is desired to package a plurality of food articles arranged in two or more rows.

It is a further object of the invention to provide a microwave package having a large interior surface area covered by a microwave interactive layer, while scorching of the carton is prevented.

It is yet another object of the invention to provide a microwave package which includes a partition which separates a plurality of food articles into smaller groups of articles with the partition having a microwave interactive layer thereon, such that a larger surface area of the articles is adjacent to a microwave interactive browning or crisping surface.

A still further object of the present invention is to provide a microwave package having an interiorly disposed member having a microwave interactive layer thereon which supplements microwave interactive layers on top, bottom or side surfaces of the package and in which the package and interiorly disposed member are formed from a single blank.

Another object of the invention is to provide a microwave package having improved surface cooking in which the package is easy to load during packaging, and easy to open after cooking.

These and other objects and advantages of the present invention are achieved by a microwave, cook-in disposable package which includes a partition which separates a food cavity of the package into two smaller food compartments with a microwave interactive layer on the partition to improve cooking of side surfaces of the articles in the food compartments. The microwave interactive layer converts a portion of the impinging microwave energy into heat. This heat in turn is conducted to the surface of the food articles providing a crisping or browning effect. The greater the contact of the food product with the interactive layer, the greater the heat conduction and consequently better browning or crisping is achieved.

In accordance with the present invention, the partition is formed from a pair of panels which are hingedly connected to a pair of cover panels of the package. The top, bottom and side walls of the package are also covered with a microwave interactive layer with the partition forming an increased surface area of the microwave interactive material which is exposed to a greater surface area of the food articles. Since the partition is formed of a double center wall, each wall having only one surface covered by a microwave interactive layer, scorching of the wall surface is prevented. In addition, since the center walls of the partition extend from panels of the package cover or top, the entire package can be formed from a single blank, thereby improving handling of the package. Moreover, the package can be dump-loaded with the top of the carton open, with the center wall partitions dividing the food articles and forcing the articles into proper alignment as the package top is closed after loading. Other objects and advantages of the present invention will become apparent after consideration of the following detailed description read in conjunction with the drawings.

DETAILED DESCRIPTION OF THE PREFERRED EMBODIMENT

Figure 1:
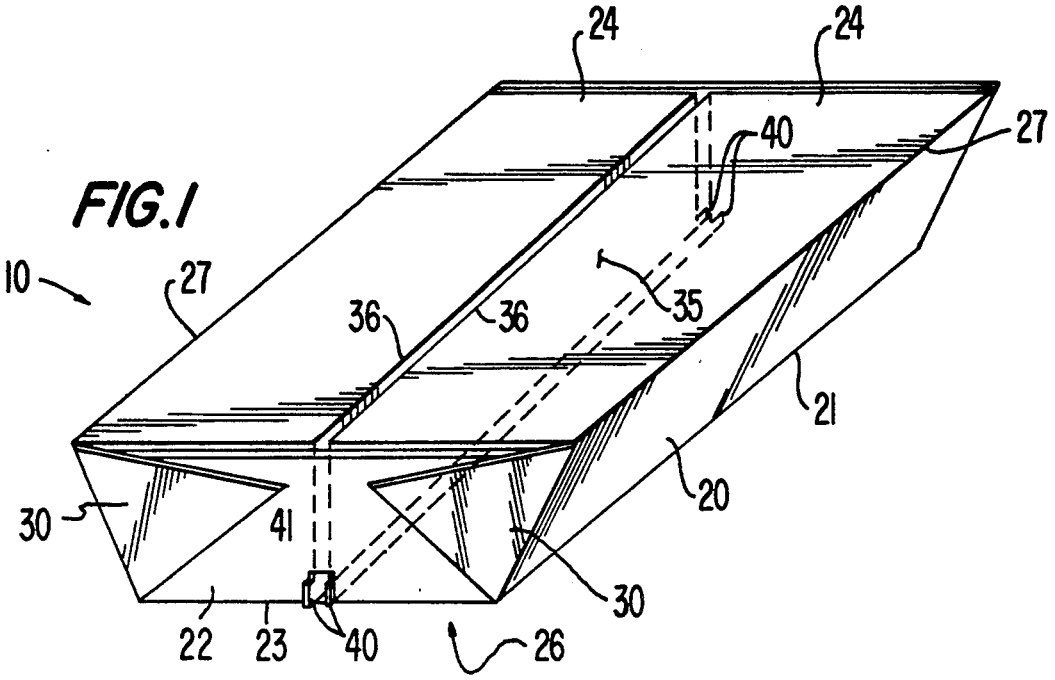
FIG. 1 is a perspective view of the microwave package having a double center wall in accordance with the present invention.

FIG. 1 shows a perspective view of a package 10 formed in accordance with the present invention. The package includes a plurality of container panels forming side walls 20, end walls 22, a bottom 26, and top or cover panels 24. The side walls 20 and end walls 22 are contiguous with the bottom as shown at corners 21 and 23. The corners 21 and 23 are folds within the package such that the end and side walls are extensions of the bottom wall, separated by the corner folds.

The side walls 20 each include a pair of triangular glue flaps 30 hingedly connected thereto. The glue flaps 30 connect the side walls 20 and end walls 22 to maintain the package in an erect configuration when glue is applied to adhesively bond the flaps 30 to end walls 22. If desired, the glue flaps can be hingedly mounted upon the end walls 22 and glued to side walls 20.

Figure 2:
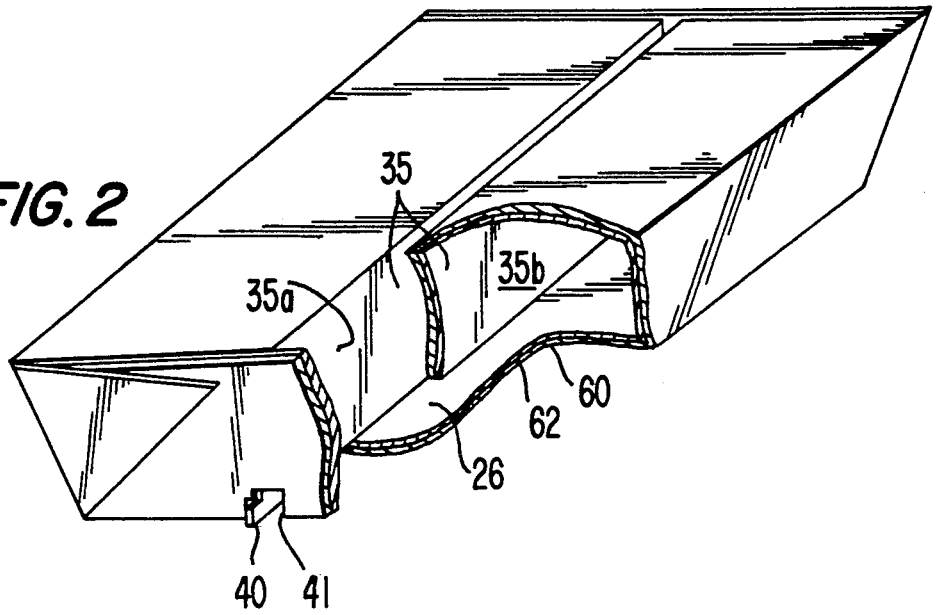
FIG. 2 illustrates the package of FIG. 1 with portions cut away.

As shown in the broken lines of FIG. 1 and in the cut-away view of FIG. 2, the package in accordance with the present invention includes a pair of center wall panels 35 which extend from the top cover panels 24 with each center wall hingedly connected to a respective one of the cover panels 24 along fold 36. The cover panels 24 are in turn connected to side walls 20 along fold 27. The center walls 35 are approximately the same height as the package 10 such that the center walls extending from the top panels are substantially in engagement with the bottom 26 when the package is closed, as shown in FIG. 1. Note however, in accordance with the present invention shorter center walls may be utilized where browning of a smaller portion of the product side surfaces is desired. In addition, while the center wall or partition is shown substantially in the center of the package, it is also possible to place the wall closer to one of the side walls, for example where different sized or different types of articles are to be placed in the respective food compartments.

To aid in initial positioning of the center walls, and to subsequently maintain the proper position of the center walls, the center walls include a pair of tabs 40 at each end thereof which fit into apertures 41 which are cut-out from each of the end walls 22. When the package is closed, the tab portions are snapped or hooked into the apertures 41 so that the cover panels 24 will not inadvertently fall open, and extensive lateral movement of the center walls 35 is restricted. Preventing lateral movement of the center walls prevents the center walls from assuming positions in which the articles of one food compartment have greater surface contact than those in the other compartment. Thus, greater cooking consistency is achieved with the proper positioning of the center walls.

The interior surfaces of each of the package panels 20, 22, 24 and 26 have a layer of a microwave interactive material 62 laminated thereon. Preferably the interactive layer is a coating of Qwik Crisp (a registered trademark of James River Corporation), which is a metalized polyester. The thickness of the microwave interactive layer 62 in FIG. 2 is exaggerated for illustrative purposes. Each of the panels include a paperboard substrate 60 upon which the interactive layer 62 is coated. As shown in FIG. 2, the center walls each include two surfaces 35A, 35B. The surface 35B of each wall which faces the interior of the respective food containing compartment is laminated with the microwave interactive material, while the surfaces 35A of each center wall which face towards one another are not laminated with a microwave interactive layer.

In accordance with an aspect of the present invention, applicants have recognized the significance of having a double center wall partition, since the double center wall provides two surfaces having microwave interactive layers thereon, while adjacent surfaces of the double center wall are not coated with a microwave interactive layer. This arrangement provides maximum surface area for the microwave interactive layer while preventing scorching of the paperboard substrate which forms the package. A single center wall having a microwave interactive layer on both sides has been found to result in scorching of the paper substrate which can diminish the effectiveness of the microwave interactive layer, resulting in improper cooking, as well as undermining the confidence of the consumer observing a scorched package after cooking. The glue flaps 30 also do not have a microwave interactive layer thereon to avoid scorching of the end walls 22.

Figure 3:
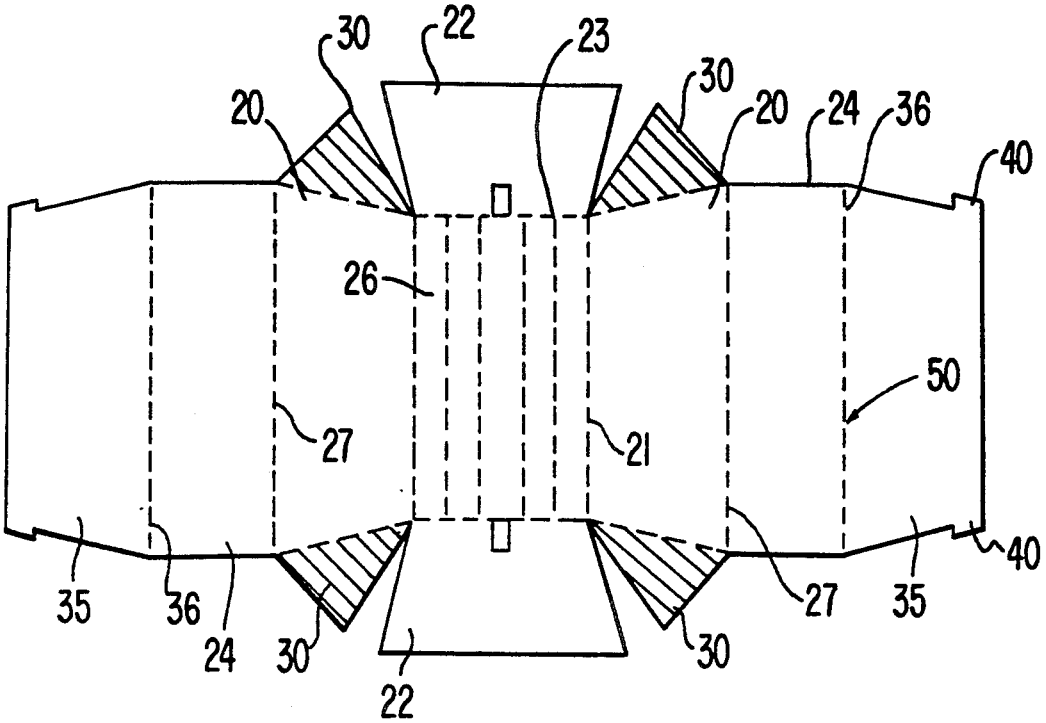
FIG. 3 is a schematic layout of the package blank for forming the package of FIG. 1.

A blank used for forming the package of FIGS. 1 and 2 is shown in FIG. 3. Conveniently, the package including the double center wall partition is formed from a single blank which eases handling and forming of the package. In the non-erect configuration, the container bottom 26 is disposed in the center of the blank, with the container side wall panels 20, cover panels 24 and partition wall panels 35 respectively extending to the right and left of the bottom wall, as shown in FIG. 3. The end wall panels 22 extend from the top and bottom of the bottom panel 26, as is also shown in FIG. 3. Each of the corner or fold lines 21, 23, 27 and 36 include cut scores 50 which aid in folding for final formation of the package.

Figure 6:
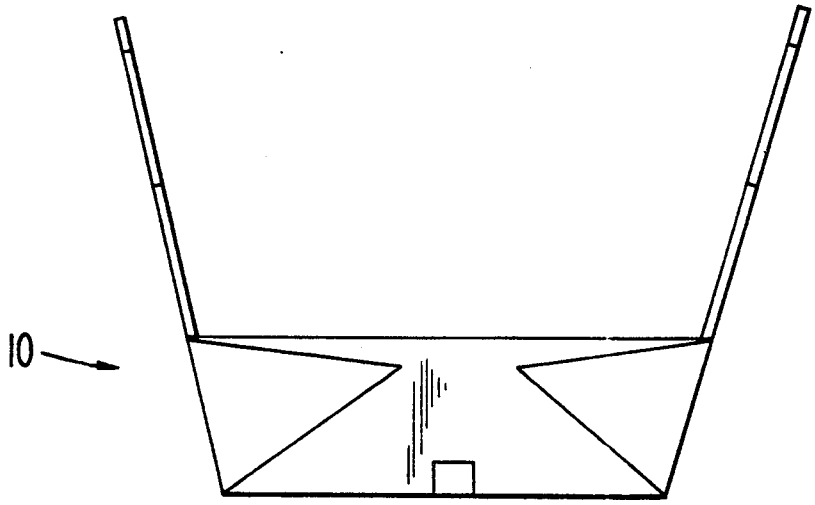
FIG. 6 is a frontal view of a container in an erect, open position for nesting or loading.

As shown in FIGS. 1–3, both the side walls 20 and end walls 22 are trapezoidal such that both the end and the side cross-sections of the package are trapezoidal. Thus, in the erect configuration, the container resembles an inverted truncated pyramid. This provides significant benefits in handling of the package and in cooking the products contained therein. As shown in FIG. 6, when the package is erect, with the cover and partition open, a tapered open package is provided such that a plurality of containers can be nested for stacking to provide a customer with a large number of erect containers. Thus, if desired, a customer can purchase a large number of erect cartons and the cartons need only to be filled and the tops closed for sale to the ultimate consumer. The customer may thus utilize the container of the present invention without having to purchase equipment required for erecting the individual container blanks. Alternatively, where a large number of blanks are required and the customer has package forming machinery available, the containers may be shipped in blank (FIG. 3) form for subsequent forming, filling and closing.

In addition, the tapered configuration of the container 10 provides a container which is adapted for easy dump loading of the food articles, since the inclined wall portions aid in orienting the articles and tend to urge the articles toward the center wall. Moreover, since the top or cover area of the package is larger than the bottom surface area, the container is particularly suitable for articles having one side which is larger than the other, or in other words, an article having a somewhat tapered configuration. The provision of a double center wall, with inclined side and end walls results in a greater surface area adjacent or in contact with the food product surface areas thereby improving the browning or crisping of the food product.

Figure 5A:
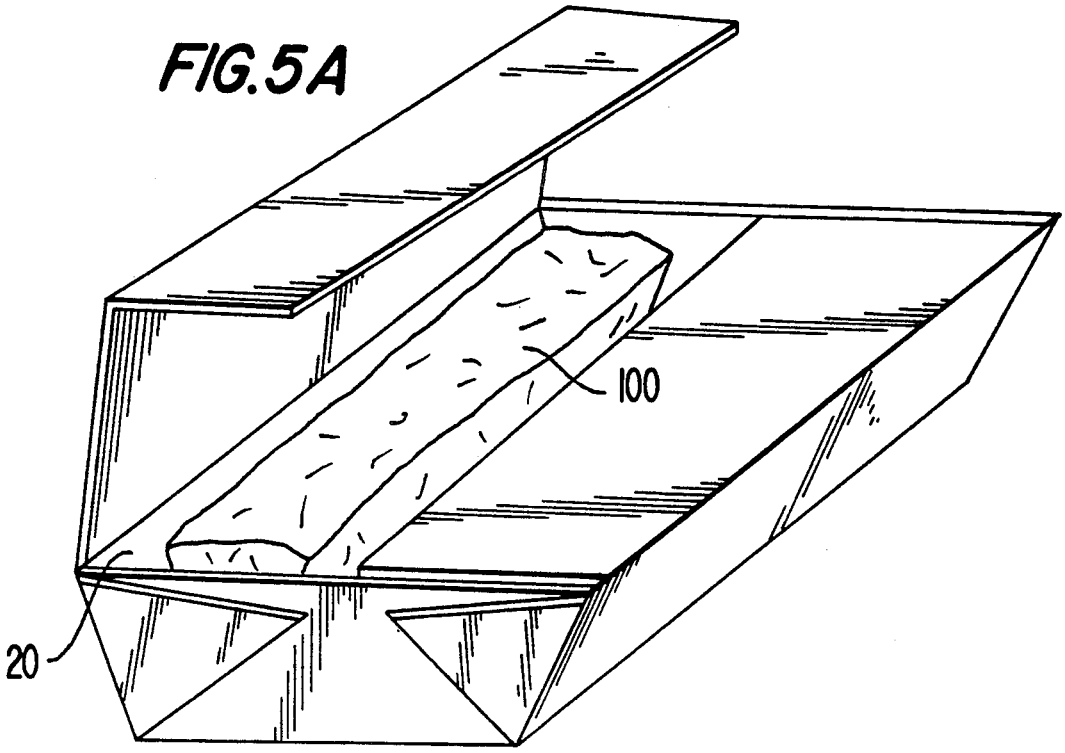
FIGS. 5A and 5B illustrate food articles in proper orientation for cooking in a package as shown in FIG. 1.

As shown in the perspective view of a container with one compartment open of FIG. 5A, a tapered article, such as a potato wedge 100 can be conveniently packed in each food compartment such that the larger top area of the wedge is adjacent the larger top package surface, while the smaller tapered end of the wedge is adjacent the bottom surface of the package. The inclined tapered side wall 20 aids not only in properly orienting the potato wedge, but also in insuring that the interior surface of the wall 20 is closely adjacent the side of the article for improved browning. Thus, as shown in FIG. 5A, the package in accordance with the present invention may be utilized for improved browning of a pair of potato wedges, since a large portion of the surface area of the potato wedge is adjacent the microwave interactive layers of the package.

Figure 5B:
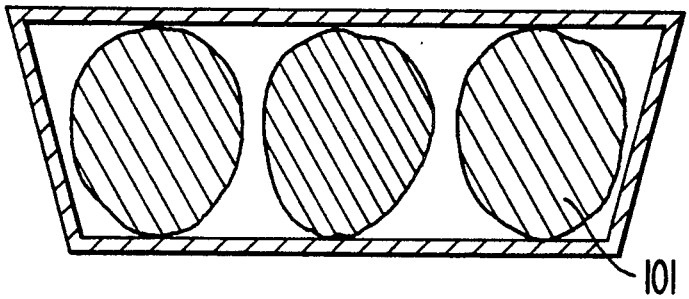

FIG. 5B shows a side sectional view of a container in which a plurality of articles, such as hush puppies 101 are arranged in two rows with three food product articles in each row. The articles, such as hush puppies are of a flattened egg-shaped configuration with the top portion of the article larger than the bottom. As with the potato wedges, the tapered container configuration aids in orienting the article and in keeping the microwave interactive layers close to the article. Articles such as apple fritters, which are approximately the same shape as hush puppies will also achieve improved crispness and/or browning.

It is to be understood that the present invention will also provide improved browning and/or crisping even where more than two rows of articles are packaged. For example, where two rows are packed in each cavity, browning will occur on at least one side surface of each article as a result of either a center wall or a side wall. In contrast, with prior art packages only the peripheral side surfaces of articles in a four-row array would be browned. It is also understood that many other food products will realize improved results when cooked in the container of the present invention in addition to those mentioned above.

Figure 4:
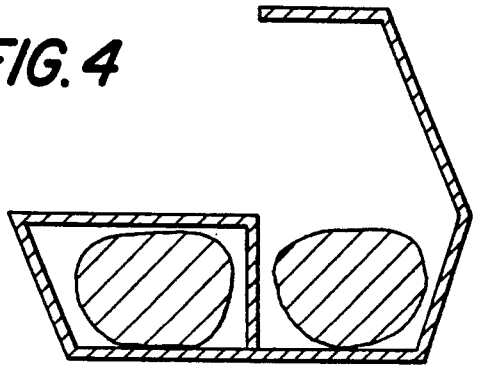
FIG. 4 is a cross-sectional view of the package of FIG. 1 with one cover panel open.

In use, a container in the open, erect configuration (as shown in FIG. 6), is presented to a loading device which dump loads a plurality of articles into the interior food containing cavity of the package. One of the top cover panels 24 is then folded over the top with the divider or center wall panel 35 folded down between the articles (FIG. 4) , such that the partition forces the articles into proper orientation, for example into two rows of three hush puppies. The tabs 40 of the center wall or divider panel 35 engage with the cut-out area 41 of the end walls 22. Subsequently, the remaining cover panel 24 is folded over with the second divider 35 folded down and tabs 40 interlocked with apertures 41 to complete the packaging operation.

It is to be understood that while the preferred embodiment utilizes a pair of food containing cavities, each having interior surfaces laminated with a microwave interactive layer, it is also possible to laminate the microwave interactive layer such that only one of the food containing cavities includes the microwave interactive layer. This arrangement is particularly advantageous where two different food products are to be packaged together where one is in need of browning, or increased cooking, while the other does not require browning or cooks at a different rate.

In addition, the microwave interactive layer need not be uniform in the interior surfaces of one or both of the foods compartments to allow for focusing of the heat resulting from the microwave interactive layers. For example, if a particular food product has portions which become too brown or blacken, or become tough as a result of overheating, selected portions of the microwave interactive layer which are adjacent the food portions known to be overcooked may be eliminated. Focusing of the heat may also take the form of holes cut in the container walls, which alter the shielding and heating effects of the walls; or various patterns of the microwave layer may be utilized to provide for optimum cooking of the food articles. It is also to be understood that the dimensions of the container may be altered to suit various food products, or various quantities of food products.

Industrial Applicability

The disclosed invention has particular utility in cooking products in which browning or crisping of surface areas of the product is desired, and in particular where two or more product articles or two or more rows of product articles are to be cooked in a single package. The disclosed package can be conveniently shipped in the form of a single blank, or alternatively, the package may be shipped in an open, erect nested stack such that only loading and closing of the top is required. Since separately formed inserts or trays are not required, forming and handling of the package is simplified. The package may also be provided to the ultimate consumer with the food articles separate such that the consumer simply loads the container, closes the cover and places the package in the microwave. The disclosed package is ideally suited for shipping, vending and microwave heating of a variety of food products, but particularly products for which browning or crisping is desired such as hush puppies, potato wedges and apple fritters.

I claim:

1. A package for use in heating a plurality of food items by microwave energy comprising:

carton means for forming an interior food item receiving cavity;

partition means for separating said food cavity into at least two food compartments shaped to accommodate the respective food items, said partition means including at least a first side; and microwave interactive means for converting microwave energy into heat, said microwave interactive means including a microwave interactive material located on and coextensive with at least a substantial portion of said first side of said partition means to heat the surface of at least one of said food items;

wherein said carton includes a cover comprising at least one cover panel for opening and closing said compartments, said partition means comprising at least one partition wall connected to said at least one cover panel and being movable therewith out of and into said food cavity as at least one of said compartments is opened and closed, respectively.

2. The package of claim 1, wherein said partition means includes a pair of partition walls, each wall having a side facing inwardly toward a respective one of said two food compartments said first side comprising one of said inwardly facing sides;

said microwave interactive means including a microwave interactive material located on each of said inwardly facing sides.

3. The package of claim 2, wherein each of said partition walls has a second side, the respective second sides facing toward each other in closely spaced relation.

4. The package of claim 1, wherein said partition means is hingedly connected to said cover.

5. The package of claim 4, wherein said cover includes a pair of cover panels, each cover panel covering one of said compartments, and said partition means includes a pair of partition walls with each partition wall hingedly connected to a respective one of said cover panels, each of said partition walls having a side facing inwardly toward the compartment covered by the respective hingedly connected cover panel; said microwave interactive means including a microwave interactive material located on each of said inwardly facing sides.

6. The package of claim 5, wherein said carton means includes four peripheral walls and a bottom wall, wherein two of said four peripheral walls are hingedly connected to said cover panels.

7. The package of claim 6, wherein said four peripheral walls are connected to the bottom wall at four respective fold lines.

8. The package of claim 1, wherein each of said food compartments include interior surfaces, said interior surfaces including surfaces of bottom, top and side walls, and said partition means wherein a microwave interactive material is located on the interior surfaces of at least one of said compartments.

9. The package of claim 8, wherein the interior surfaces of both of said compartments include a microwave interactive material.

10. The package of claim 1, wherein said carton includes a pair of end walls having an opening, said partition means including tab means for positioning of said partition means, said package having an erect, closed configuration in which said tab means pass into and engage with said openings.

11. The package of claim 10, wherein said partition means includes a pair of partition walls, each wall having two tabs forming said tab means, one tab of each partition wall passing into the opening of one of said pair of end walls, the other tab of each partition wall passing into the opening of the other of said pair of end walls when the package is in the erect, closed configuration.

12. The package of claim 10, wherein each of said partition walls includes two sides, one side of each partition wall facing toward a respective side of the other partition wall, the other side of each partition wall having a microwave interactive material thereon.

13. The package of claim 1, further including a food product located within each of said food compartments.

14. The package of claim 13, wherein each of said two food compartments includes interior surfaces; and a microwave interactive material is located on at least a portion of the interior surfaces of each compartment.

15. The package of claim 14, wherein the food product is hush puppies.

16. The package of claim 14, wherein said food product comprises a row of food articles in each compartment.

17. The package of claim 14, wherein said food product is a potato wedge, with one wedge in each of said compartments.

18. The package of claim 14, wherein said food product is apple fritters.

19. The package of claim 1, wherein said carton means includes peripheral walls, at least one of which is inclined.

20. The package of claim 1, wherein said carton means includes four inclined peripheral walls.

21. A package for use in heating a plurality of food items by microwave energy comprising:

carton means for forming an interior food item receiving cavity, said carton means including a bottom and a cover;

said cover including a pair of cover panels which are individually movable for opening and closing said carton means, and associated depending panels which, when the cover panels are in a closed position extend from each of said cover panels toward said bottom, said depending panels being arranged to move out of the interior food cavity as a respective cover panel is moved to an open position and to divide said interior food cavity into two food compartments shaped to accommodate the respective food items when a respective cover panel is moved to a closed position;

said depending panels each having a first side; said first sides facing toward each other when the cover panels are in a closed position, each of said panels further including a second side;

microwave interactive means located on each of said second sides for heating the surface of at least one of said food items and at least one said food item being located within each of said two food compartments.

22. The package of claim 21, wherein said depending panels each include a lower edge in engagement with said bottom.

23. The package of claim 21, wherein said bottom has a surface area which is smaller than a sum of cover panel surface areas.

24. The package of claim 21, wherein said carton means includes side walls;

said side walls each including an interior surface;

said cover panels each including an interior surface;

said bottom including an interior surface; and a microwave interactive material associated with each of the interior surfaces of said side walls, said cover panels and said bottom.

25. The package of claim 24, further including means for liquid removal on the interior surface of said bottom.

26. The package of claim 25, wherein said means for liquid removal includes a plurality of slots cut through the microwave interactive material of said bottom.

27. The package of claim 24, further including at least one hush puppy within each of said food compartments.

28. The package of claim 24, further including a row of hush puppies in each food compartment.

29. The package of claim 24, further including at least one apple fritter in each food compartment.

30. The package of claim 24, further including at least one potato wedge within each food compartment.

31. The package of claim 21, wherein said depending panels are located in a central portion of said food cavity.

32. A blank for a microwave package for use in heating a plurality of food items comprising:

a central panel adapted to form a package bottom wall;

four side panels connected to said central panel for forming a package peripheral wall surrounding the central panel;

a first pair of panels each connected to a separate one of said four panels for forming a package top wall which is movable to open and close a food capacity defined by said central panel wall and peripheral wall;

a second pair of panels each connected to a separate one of said first pair of panels for forming a package partition subdividing the food cavity into at least two food compartments shaped to accommodate the respective food items one of said second pair of panels having a microwave interactive material thereon, such that said second pair of panels forms a partition when said package is erect and said food cavity is closed by the package top wall, said second pair of panels being arranged to move to an open position, and said one of said second pair of panels providing a microwave interactive material exposed to the interior of one of the at least two food compartments to heat the surface of at least one of said food items.

33. The blank of claim 32, wherein each of said four panels is trapezoidal.

34. The blank of claim 32, further including one or more glue flaps connected to at least two of said four panels.

35. The blank of claim 32, further including a plurality of scores in said central panel.

36. The blank of claim 32, wherein each of said second pair of panels includes microwave interactive means located thereon for providing heat to two compartments of a microwave package.

37. The package of claim 1, wherein said partition means forms a substantially planar partition having said microwave interactive material located on said first side thereby providing a substantially planar microwave interactive surface means for providing heat to one of said at least two food compartments.

38. The microwave package of claim 1, wherein said partition means includes first and second sides each facing inwardly toward a respective one of said at least two food compartments, wherein said first and second sides are substantially planar; and wherein a microwave interactive material is located on each of said first and second sides thereby providing substantially planar microwave interactive surface means for providing heat to each of the respective food compartments.

39. The package of claim 21, wherein said carton means includes a pair of end walls, at least one of said depending panels including positioning means for engaging said end walls to position the at least one depending panel.

40. The package of claim 39, wherein each of said depending panels includes positioning means, said positioning means including a pair of tabs located on each of said depending panels which protrude into at least one opening located on each of said end walls.

* * * * *